US008161775B2

(12) United States Patent
Mi et al.

(10) Patent No.: US 8,161,775 B2
(45) Date of Patent: Apr. 24, 2012

(54) INTEGRATED HOLLOW FABRIC STRUCTURE

(75) Inventors: Zhong-Xing Mi, Raleigh, NC (US); Qian Zhao, Nanjing (CN); Youjiang Wang, Atlanta, GA (US); Shijie Chen, Nanjing (CN)

(73) Assignees: Stoneferry Technology, LLC, Atlanta, GA (US); Sinoma Science & Technology Ltd., Nanjing (CN)

( * ) Notice: Subject to any disclaimer, the term of this patent is extended or adjusted under 35 U.S.C. 154(b) by 0 days.

(21) Appl. No.: 13/049,465

(22) Filed: Mar. 16, 2011

(65) Prior Publication Data

US 2011/0165350 A1 Jul. 7, 2011

Related U.S. Application Data

(63) Continuation-in-part of application No. 12/503,944, filed on Jul. 16, 2009, now Pat. No. 8,082,761.

(51) Int. Cl.
*D04B 39/06* (2006.01)

(52) U.S. Cl. ..... 66/190; 66/170

(58) Field of Classification Search ..... 66/1 R, 66/7, 90, 116, 169 R, 170, 190; 139/383 B, 139/384, 1 R See application file for complete search history.

(56) References Cited

U.S. PATENT DOCUMENTS

| | | | | | |
|---|---|---|---|---|---|
| 3,834,424 | A | * | 9/1974 | Fukuta et al. | 139/22 |
| 4,001,478 | A | | 1/1977 | King | |
| 4,066,104 | A | * | 1/1978 | Halton et al. | 139/11 |
| 4,312,261 | A | | 1/1982 | Florentine | |
| 4,346,741 | A | | 8/1982 | Banos et al. | |
| 4,506,611 | A | | 3/1985 | Parker et al. | |
| 4,518,640 | A | | 5/1985 | Wilkens | |
| 4,863,660 | A | * | 9/1989 | Cahuzac et al. | 264/103 |
| 5,085,252 | A | | 2/1992 | Mohamed et al. | |
| 2005/0235471 | A1 | | 10/2005 | Delecroix | |

* cited by examiner

*Primary Examiner* — Larry Worrell, Jr.

(74) *Attorney, Agent, or Firm* — Morris Manning & Martin LLP; Tim Tingkang Xia, Esq.

(57) ABSTRACT

In one aspect of the invention, an integrated hollow fabric structure includes a body having an axis and a thickness along a direction perpendicular to the axis, at least first and second groups of yarns, the yarns of each group space-regularly disposed in layers, where the yarn layers of the at least two groups of yarns are alternately stacked and interlocked together, and embedded in the body, and a third group of yarns through the thickness of the body to interlock the layers together, where the positions and the pattern of interlocking vary according to the need.

22 Claims, 10 Drawing Sheets

INTEGRATED HOLLOW FABRIC STRUCTURE

CROSS-REFERENCE TO RELATED PATENT APPLICATION

This application is a continuation-in-part of U.S. patent application Ser. No. 12/503,944, filed Jul. 16, 2009, entitled "METHOD AND APPARATUS OF FORMING INTEGRATED MULTILAYER FABRICS", by Youjiang Wang, Qian Zhao, Zhong-Xing Mi, and Jianzhong Zhang, the disclosure of which is incorporated herein by reference in its entirety.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference were individually incorporated by reference.

FIELD OF THE INVENTION

This invention generally relates to multilayer fabrics, and more particularly to integrated multilayer fabrics having a prescribed integration pattern formed of winding yarns arranged in a plurality of layers at prescribed angles bound together by a set of through-the-layers binder yarns.

BACKGROUND OF THE INVENTION

Integrated multilayer fabrics have wide applications such as advanced composites, power transmission and conveyer belts, fabrics in paper forming machines, among others.

Advanced composites include high performance fibers in a matrix. Depending on the fibers and matrix materials and manufacturing parameters, advanced composites offer superior strength-to-weigh and modulus-to-weight ratios, fatigue strength, damage tolerance, tailored coefficient of thermal expansion, chemical resistance, weatherability, temperature resistance, among others.

Fibers are the basic load-bearing component in a fiber reinforced composite. They are often pre-assembled into various forms to facilitate the fabrication of composite parts. Advanced composites are often made from prepreg tapes, sheets and fabrics that are parallel continuous fibers or single-layer fabrics held by a matrix forming material. They are used to make parts by laminate layup and tape or filament winding. The traditional laminated composites are vulnerable to delamination because the layers of strong fibers are connected only by the matrix material that often is much weaker than the fibers. The introduction of fiber reinforcement in the through-the-thickness direction in a three dimensional composite could effectively control delamination failures and make the composite very damage tolerant. Besides performance enhancement, composites reinforced with integrated fiber structures may also offer other advantages such as the potential for automated and net shape processing and lower manufacturing cost.

Planar multilayer fabrics having layers of parallel fibers at predetermined angles bound by a knitting process, known as non-crimp fabrics, are also commonly used in reinforced composites. Methods of making such multilayer fabrics are disclosed in U.S. Pat. No. 4,518,640 to Wilkens. These methods are suitable for making flat fabrics with fixed width and yarn orientations. The in-plane layers normally include high performance fibers such as glass and/or graphite fibers, whereas the knitting yarns generally are made of flexible fibers such as poly(ethylene terephthalate) (PET) or aramid rather than using the same type of high performance fibers as in the in-plane layers.

Fabrics with solid rectangular or other cross sectional shapes such as I and T sections may be constructed with reinforcing fibers in both in-plane and through-the-thickness directions by three dimensional weaving and braiding processes, as disclosed in, for examples, U.S. Pat. No. 4,312,261 to Florentine and U.S. Pat. No. 5,085,252 to Mohamed et al. These processes are generally limited in the cross sectional shapes and dimensions of the fabrics that can be produced.

Fully interlocked and adjacent layer interlocked three dimensional fabrics may be formed by weaving or braiding. Hollow fabrics such as tubular structures may be made according to, for example, U.S. Pat. No. 4,174,739 to Rasero et al. In such fabrics the yarns are crimped due to yarn interlacing or intertwining, and the yarn crimps in the fabrics cause a reduction in the stiffness and strength of the composites reinforced with such fabrics. Although the fabrics layers are integrated by interlocking, there are no reinforcing yarns placed directly in the through-the-thickness direction.

Composite parts reinforced with hollow fabrics are widely used for many applications. The composites are often constructed from flat fabrics in which the fibers are discontinuous. Hollow fabrics such as tubular fabrics may be constructed directly from yarns, and the yarns are primarily placed in the axial, radial and circumferential directions, as disclosed in, for example, U.S. Pat. No. 4,001,478 to King, and U.S. Pat. No. 4,346,741 to Banos et al. and U.S. Pat. No. 6,129,122 to Bilisik. Such fabrics do not afford the flexibility of changing the fabrics geometry and yarn orientation at different locations in the fabrics as needed. The traditional integrated hollow fabrics lack the flexibility of varying the fiber orientation and/or the cross sectional shape and/or dimension as the fabrics are being formed. They are often associated with other disadvantages such as low fiber volume fraction, limitation in fiber orientations, and forming a net-shaped structure, among others.

Therefore, a heretofore unaddressed need exists in the art to address the aforementioned deficiencies and inadequacies.

SUMMARY OF THE INVENTION

Accordingly, an object of the present invention is to provide novel integrated hollow fabric structures and their variants which overcome the aforementioned problems described above.

One object of the present invention is to provide integrated hollow fabric structures having improved structural properties including more uniform resistance to deformation, integrity and isotropic strength, if required, in the fabric surface directions, respectively.

Another object of the present invention is to provide integrated hollow fabric structures having improved structure properties in the thickness direction of the fabric.

Yet, another object of the present invention is to provide integrated hollow fabric structures having improved stability in structural properties at higher temperatures.

A further object of the present invention is to provide integrated hollow fabric structures of variable cross-sectional geometry such that the cross-sectional dimensions can vary along the lengthwise direction of the fabrics.

Yet, a further object of the present invention is to provide integrated hollow fabric structures of variable cross-sectional geometry such that the wall thickness for the fabrics in a hollow form, or the thickness of the fabrics in solid form, can vary along the lengthwise direction of the fabrics.

An alternative object of the present invention is to provide integrated hollow fabric structures of variable cross sectional geometry such that the integration pattern can vary by the fixation or omission of selected binder yarns or by the method of binder yarn fixation.

Yet, an alternative object of the present invention is to provide integrated hollow fabric structures in which the yarn orientation of each layer may vary along the lengthwise direction and/or in the thickness direction of the fabrics, if required.

In one aspect of the present invention, the integrated hollow fabric structure has a generally cylindrical shape having a central axis, and comprises at least first and second groups of winding yarns, each group having a plurality of winding yarns regularly arranged in one or more layers, where the winding yarn layers of the first and second groups are alternately stacked in the radial direction to an inner surface, an outer surface and a radial thickness therebetween, and the plurality of winding yarns of the first group is helically oriented at a first angle, $\alpha 1$, relative to the central axis, and the plurality of winding yarns of the second group is helically oriented at a second angle, $\alpha 2$, relative to the central axis, thereby defining a plurality of crossovers of winding yarns. The angle $\alpha 1$ of different winding yarn layers of the first group may be the same or substantially different. Similarly, the angle $\alpha 2$ of different winding yarn layers of the second group may be the same or substantially different. In one embodiment, $-90° \leqq \alpha 1 \leqq 90°$, $-90° \leqq \alpha 2 \leqq 90°$, and $\alpha 1 = -\alpha 2$. In another embodiment, $-90° \leqq \alpha 1 \leqq 90°$, $-90° \leqq \alpha 2 \leqq 90°$, and $\alpha 1 \neq -\alpha 2$.

In one embodiment, the plurality of winding yarns of each group is disposed substantially in parallel to one another.

The integrated hollow fabric structure further comprises a plurality of binder yarns. Each binder yarn defines alternately a plurality of binder loops and a plurality of holding loops interlaced with corresponding crossovers formed by winding yarns for interlocking the winding yarn layers of the first and second groups, where each binder loop receives at least one crossover at the inner surface and each holding loop is placed between crossovers and exposed to the outer surface. The integrated hollow fabric structure may also comprise at least one holding yarn received in the holding loops of the plurality of binder yarns.

In one embodiment, the plurality of binder loops and the plurality of holding loops of each binder yarn define a plane. The plurality of binder loops and the at least one holding yarn are disposed on the surface of the fabric.

In another aspect of the present invention, the integrated hollow fabric structure includes a body having an axis and a thickness along a direction perpendicular to the axis, at least first and second groups of yarns, the yarns of each group space-regularly disposed in layers, where the yarn layers of the at least two groups of yarns are alternately stacked and interlocked together, and embedded in the body; and a third group of yarns through the thickness of the body to interlock the layers together, where the positions and the pattern of interlocking vary according to the need.

In one embodiment, the yarns of each group are disposed substantially in parallel respect to one another and are inclined with respect to the axis of the body. The yarns of the first and second groups define a plurality of crossovers. The yarns of the first group are inclined at a first angle, $\alpha 1$, relative to the axis of the body, and the yarns of the second group are inclined at a second angle, $\alpha 2$, relative to the axis of the body, where $-90° \leqq \alpha 1 \leqq 90°$, $-90° \leqq \alpha 2 \leqq 90°$, and $\alpha 1 = -\alpha 2$. In another embodiment, $-90° \leqq \alpha 1 \leqq 90°$, $-90° \leqq \alpha 2 \leqq 90°$, and $\alpha 1 \# -\alpha 2$.

In one embodiment, the third group of yarns is oriented along the axis direction of the body, the circumferential direction of the body, or a combination thereof.

In one embodiment, the body has a cross sectional profile that is in a regular or irregular shape, where the cross sectional profile varies along the axis direction.

In one embodiment, the body is formed of material, stable or unstable at the elevated temperature. In another embodiment, the body is formed of carbonaceous or non carbonaceous.

In one embodiment, the integrated fabric structure has a cross-sectional geometry of an integrated hollow circular, an integrated hollow oval, an integrated hollow square, an integrated hollow rectangle, or the like, and wherein the integrated fabric structure has a thickness that is uniform or variable.

In one embodiment, by varying the forming process and/or reshaping the integrated fabric, the fabric structure has a flat, a T-like shape, or the like with a solid cross section, and wherein the integrated fabric structure has a thickness that is uniform or variable.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention only. The shapes, positions, quantities, and movements of parts in the drawings are to illustrate the execution of functions and processing steps and they are by no means represent all the possible alternative implementations covered by this invention. Wherever possible, the same reference numbers are used throughout the drawings to refer to the same or like elements of an embodiment, wherein.

DETAILED DESCRIPTION OF THE INVENTION

Figure 1A:
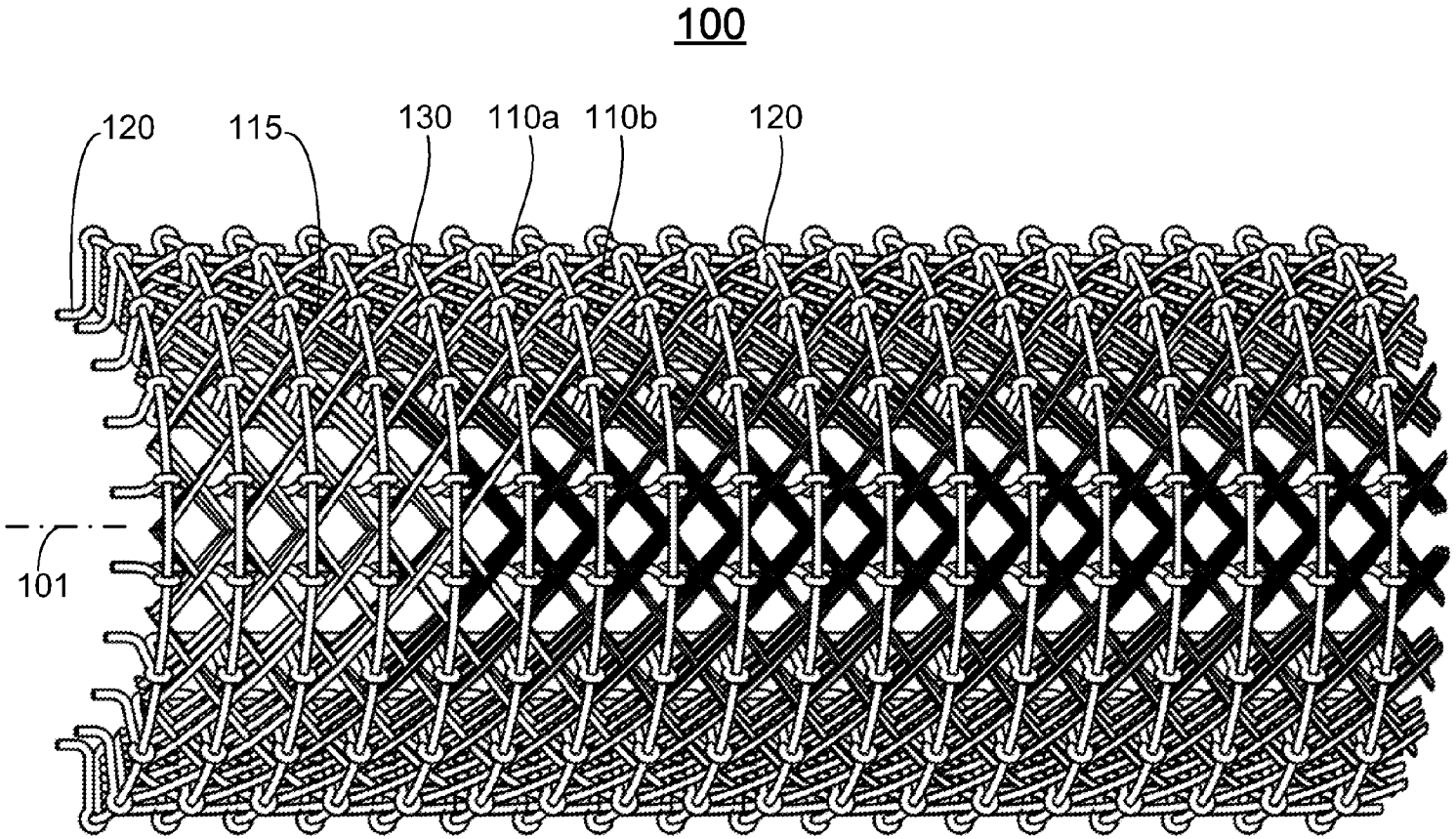
FIGS. 1A-1C show schematically different views of an integrated hollow fabric structure according to one embodiment of the present invention, A) a perspective view, B) a cross sectional view and C) another cross-sectional view.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The term, "yarn", as used herein, refers to a linear body including fibers or an assembly of fibers. It may be in the form of spun yarns, mono or multi filament yarns, singles yarns, plied yarns, or other form of strands. It may contain fibers that are twisted together or untwisted. It may also be in the form of a preimpregnated (prepreg) strand/tape including a reinforcing fiber and a matrix-forming material. The fibers may be made of different materials including but not limited to carbon, glass, aramid or a combination of different fibers (hybrids).

As used herein, the terms inner surface and outer surface refer to the inner wall and outer wall of the fabric, respectively. They may also refer to any two surfaces on the opposite sides of the fabric.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to integrated hollow fabric structures formed of yarns arranged in a plurality of layers at prescribed angles bound together by a set of through-the-layers yarns. The integrated hollow fabric structures can be tailored to have a variety of constant or variable cross sectional shapes, constant or variable yarn orientation and integration patterns according to requirements for local yarn architecture and fabrics geometry.

In the integrated hollow fabric structures, there are two systems of yarns, one is the system of winding yarns and the other is system of binder yarns. The winding yarns are arranged in a plurality of layers at prescribed angles that can vary in ranges from about −90° to about +90° with respect to longitudinal direction of the fabrics. The binder yarns are to fasten, through-the-layers, the layers of winding yarns together. The binder yarns may form loops to lock themselves in the fabric, or an auxiliary system of holding yarns may be used to lock the binder yarns in place. Since the primary function of the holding yarns is not to provide structural strength and stiffness to the fabrics structure but to simply hold the binder yarns in place, flexible fibers such as nylon or PET threads may be used as the holding yarns. The supply yarns to form each layer of winding yarns are placed in an individual carrier. Fabrics with desired cross sectional shape, yarn orientation and integration patterns are formed by repeating a cycle of operations which includes the following steps: forming a plurality of new cross over points of the winding yarns by moving each of the winding yarn carriers according to the integration pattern; transporting a plurality of the binder yarns through the layers of the winding yarns at desired locations and locking the binder yarns in place; pushing the binder yarns to the position to form the fabrics and removing any slacks in the yarns and taking up the newly formed fabrics by a controlled distance in the direction of the machine direction, i.e., the longitudinal direction of the fabrics. The newly formed fabric may be condensed in the circumferential direction, thickness direction or a combination of directions by motion of condensing element or elements. The integrated hollow fabric structures having variable cross sectional shapes, variable yarn orientations, and variable integration patterns are formed by controlling the number of yarn layers engaged, the relative distances of the winding yarn carriers movement, and activation or omission of binder yarns as the forming process proceeds.

Figure 1B:
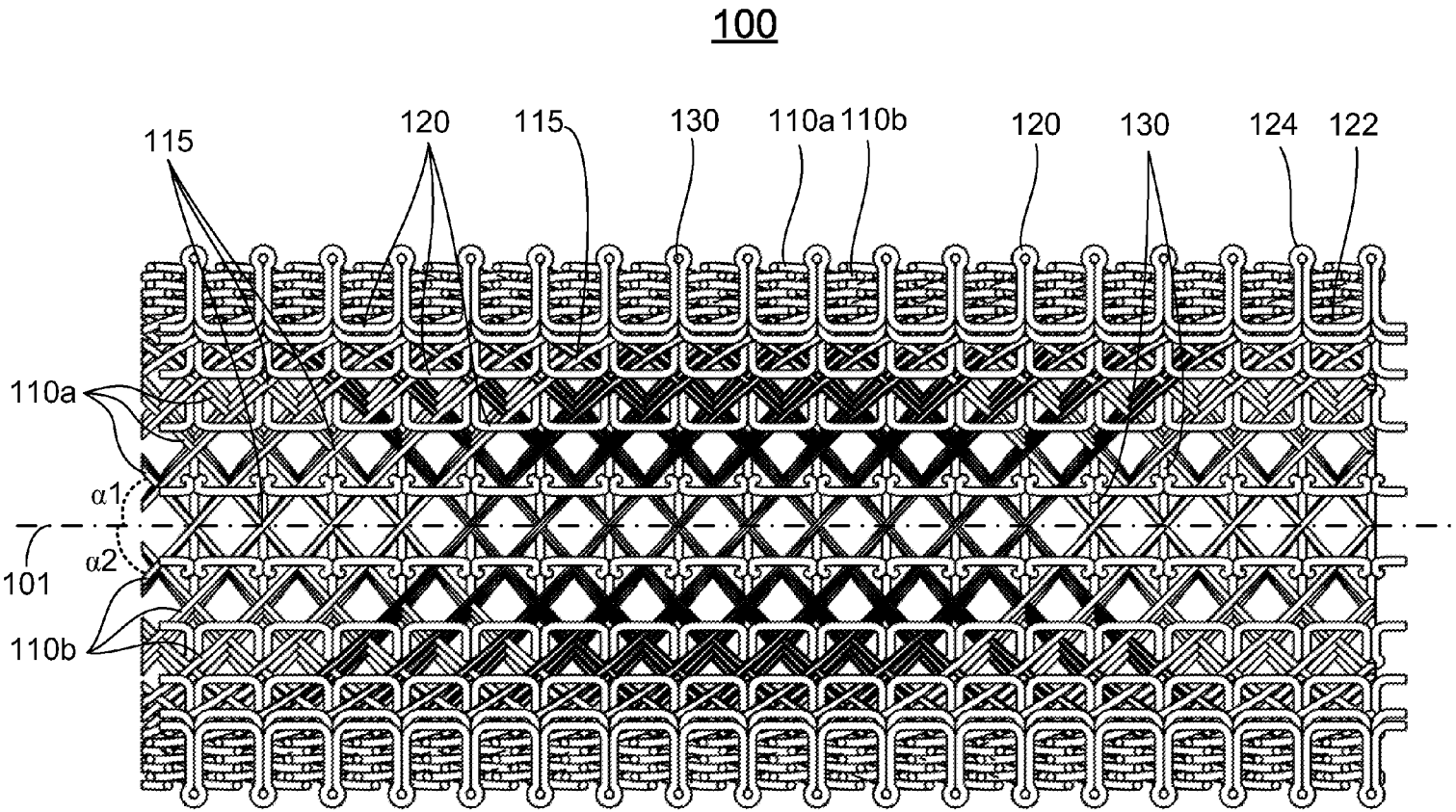
Figure 1C:
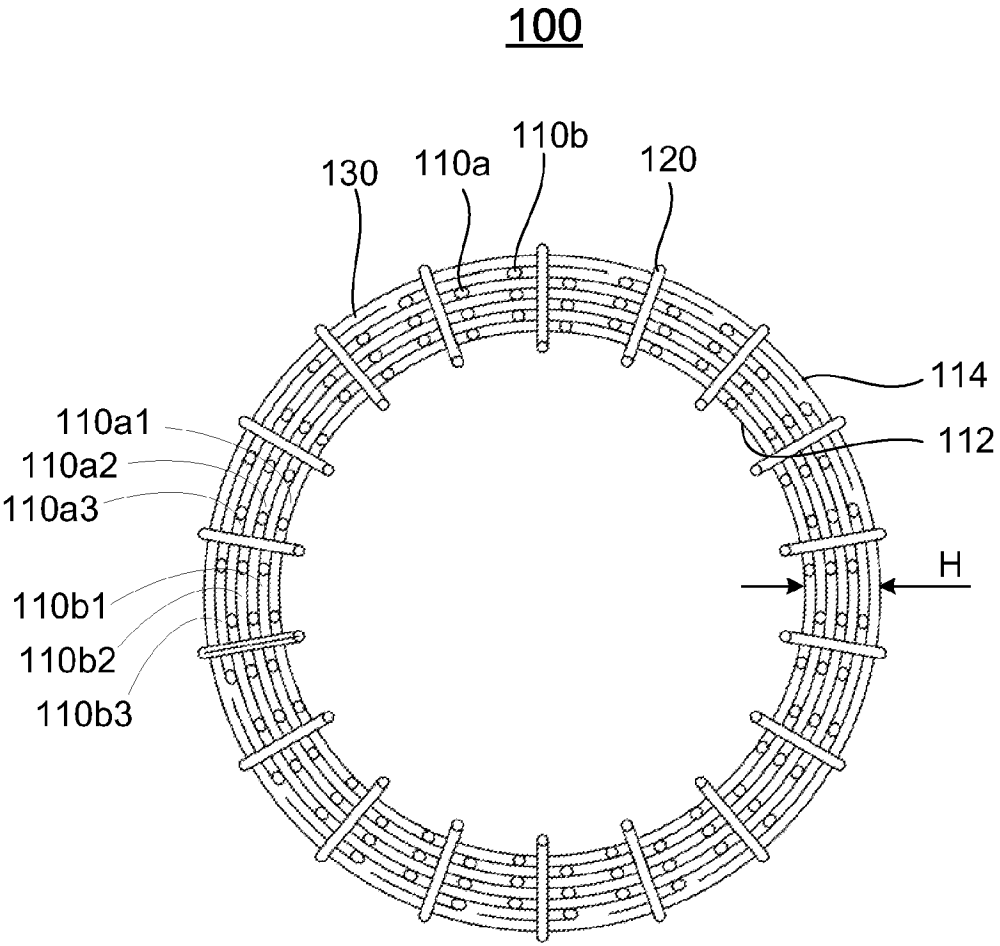

FIGS. 1A-1C show an exemplary integrated hollow fabric structure 100 according to the present invention. The integrated hollow fabric structure 100 has a generally cylindrical shape having a central axis 101.

The integrated hollow fabric structure 100 includes first and second groups of winding yarns. Each group has a plurality of winding yarns 110*a* (110*b*) regularly arranged in three layers 110*a*1, 110*a*2, 110*a*3 (110*b*1, 110*b*2, 110*b*3). The winding yarn layers 110*a*1, 110*a*2 and 110*a*3 of the first group, and the winding yarn layers 110*b*1, 110*b*2 and 110*b*3 of the second group are alternately stacked in the radial direction to define an inner surface 112, an outer surface 114 and a radial thickness, H, therebetween, as shown in FIG. 1C. For example, the layer 110*b*1 is disposed on the layer 110*a*1, the layer 110*a*2 is disposed on the layer 110*b*1, and so on. The number of layers formed by winding yarns may be adjusted as needed.

The plurality of winding yarns 110*a* (110*b*) of each group is disposed substantially in parallel to one another. The plurality of winding yarns 110*a* of the first group is helically oriented at a first angle, $\alpha 1$, relative to the central axis 101. The plurality of winding yarns 110*b* of the second group is helically oriented at a second angle, $\alpha 2$, relative to the central axis 101. According to the invention, $-90° \leqq \alpha 1 \leqq 90°$, and $-90° \leqq \alpha 2 \leqq 90°$. Preferably, $\alpha 2 = -\alpha 1$. When al and/or $\alpha 2$ are near 0°, the winding yarns are placed in the longitudinal direction of the fabric, and when al and/or $\alpha 2$ are close to 90° or −90°, the winding yarns are placed in the circumferential direction of the fabric. The angle $\alpha 1$ of different winding yarn layers of the first group may be the same or substantially different. Similarly, the angle $\alpha 2$ of different winding yarn layers of the second group may be the same or substantially different.

Further, the plurality of winding yarns 110*a* of the first group and the plurality of winding yarns 110*b* of the second group define a plurality of crossovers 115.

The integrated hollow fabric structure 100 further includes a plurality of binder yarns 120. Each binder yarn 120 defines alternately a plurality of binder loops 122 and a plurality of holding loops 124 interlaced with corresponding crossovers 115 for interlocking the winding yarn layers 110*a*1, 110*a*2, 110*a*3, 110*b*1, 110*b*2 and 110*b*3 of the first and second groups. As shown in FIGS. 1A and 1B, each binder loop 122 receives a crossover 115 at the inner surface 112, and each holding loop 124 is placed between crossovers 115 and exposed to the outer surface 114.

The integrated hollow fabric structure 100 may also include one or more holding yarn 130 that are received in the holding loops 124 of the plurality of binder yarns 120, and disposed on the outer surface 114 circumferentially. The integration pattern may be varied. In one embodiment, the holding yarn is entirely omitted by self-locking the binder yarns. In another embodiment, the holding yarn is disposed on the outer surface in a direction other than the circumferential direction. In yet another embodiment, the binder loops formed by a binder yarn may receive more than one crossovers.

According to the present invention, integrated hollow fabric structures can be fabricated with two systems of yarns: the winding yarns and the binder yarns. The winding yarns are arranged in a plurality of layers at prescribed angles that can vary in the ranges from about −90° to about +90° with respect to longitudinal direction of the fabrics. The binder yarns are used to fasten the desired layers of the winding yarns together. The number of the layers of winding yarns can be varied as desired but limited by the number of winding yarn carriers in the apparatus. In one embodiment, the layers of winding yarns may be shaped by an optional mandrel of appropriate geometry along the machine direction to form integrated hollow fabrics or fabrics with a core. The winding yarn orientations for the individual layers can be altered for different locations within the fabrics as the fabrics are being formed.

If used, the optional mandrel may be removed from the completed fabric, or the mandrel may remain in the completed fabric as part of the fabric structure. In the latter case, the mandrel may be made of a light-weight core material, a fiber assembly, a reinforced composite, among others.

Figure 2:
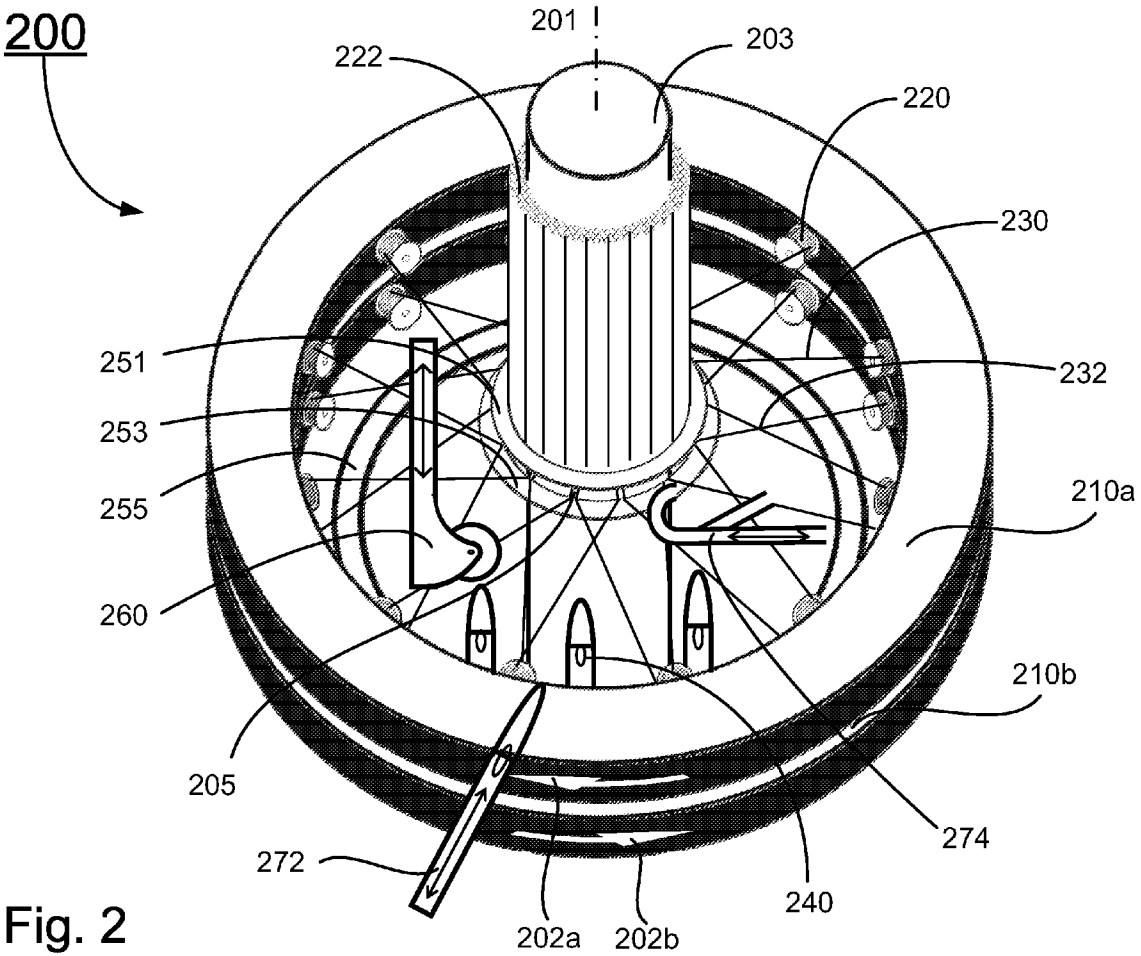
FIG. 2 shows schematically an apparatus for fabricating the integrated hollow fabric structure according to one embodiment of the present invention.

FIG. 2 shows systematically an apparatus 200 for fabricating integrated hollow fabric structures with a prescribed integration pattern according to one embodiment of the present invention. The apparatus 200 has two winding yarn carriers 210*a* and 210*b* arranged in a two-layer structure along a first direction 201 and configured such that each winding yarn carrier 210*a*/210*b* is operably movable with respect to one another along a second direction 202*a*/202*b* that is perpendicular to the first direction 201. The winding yarns 230 are provided by a plurality of yarn supply packages 220. The yarn supply packages 220 supplying the winding yarns 230 to form each layer of the fabrics are spaced mounted on one individual yarn carrier 210*a*/210*b*. In this exemplary embodiment shown in FIG. 2, a mandrel 203 is employed to take up the fabricated fabrics 222, and the ends of the winding yarns 230 extending from the supply yarn packages 220 are incorporated into the fabrics laid on the mandrel 203. The movements of one or more winding yarn carriers 210*a* and 210*b* in opposite directions 202*a* and 202*b* create a plurality of crossover points 232 by the corresponding winding yarns 230.

In this embodiment, the winding yarn carriers 210*a* and 210*b* are configured to be angularly rotatable either individually or cooperatively, along the directions 202*a* and/or 202*b*. The rotations of the winding yarn carriers 210*a* and 210*b* are around the axis 201 of the mandrel 203. Accordingly, tubular or tubular-like multilayer fabrics can be fabricated. In other embodiments, the winding yarn carriers may be configured to be translationally movable either individually or cooperatively along a (second) direction that is perpendicular to a (first) direction along which the winding yarn carriers are aligned/arranged. In operation, the movements of the winding yarn carriers are controlled by the control system. The prescribed integration pattern is formed by controlling the layer number of the winding yarns, relative distances of the winding yarn carrier movements, the distance of fabric take up in the first direction, and activation or omission of the binder yarns in operation. In yet other embodiments, the axis of the fabric does not coincide with or parallel to the axis of the apparatus (first direction 201). Additionally, two winding yarn carriers 210*a* and 210*b* are utilized in the exemplary embodiment, and thus the supplied winding yarns 230 from the two winding yarn carriers 210*a* and 210*b* form a two winding yarn layers. However, there is no limitation on the number of the winding yarn carriers to be used to practice the present invention. According to the present invention, the number of the winding yarn carriers determines the maximum number of layers of the fabrics to be produced.

Each carrier of the winding yarns places the yarns in a ply at a desired angle by a motion in the circumferential direction such as the rotation of a rigid ring carrier. The winding yarn carriers may be rigid or flexible. Rigid carriers may be circular as described in the example or having other geometric shapes. Examples of flexible carriers include belts, chains, and linked mechanisms moving on tracks.

In one embodiment, winding yarns from some of the winding yarn carriers can be supplied from a stationary creel. These carriers may remain stationary during the process to place 0° layers of winding yarns, or may move in a back and forth motion to form ribs in the fabric.

Packages to supply the winding yarns may contain one yarn per package, or multiple yarns in a single package to supply multiple threads during the winding motion. The packages may be of flanged, cross wound, or other configurations. The winding yarn packages may be placed on the inside face, on the outside face, on a side face, inside the carrier, or by other arrangements.

Additionally, one or more tension control devices (not shown) may be fitted on each winding yarn carrier to regulate the tension of the winding yarns as they are withdrawn. A braking mechanism may be employed as a separate or as a part of the tension control device to prevent the winding yarns from being withdrawn during beat-up.

The apparatus 200 also has one or more binder yarn insertion needles 240 positioned in relation to the plurality of winding yarn carriers 210*a*/210*b* for transporting/inserting binder yarns through the plurality of winding yarn layers at the predetermined locations along the first direction 201, so as to fasten the plurality of winding yarn layers together through-the-layers.

The binder yarns are provided by appropriate packages that can be individual packages or multi-thread packages such as beams. The binder yarns are inserted through the layers of winding yarns 230 at appropriate internals specified by the integration pattern and are locked in place. The binder yarns may be introduced in the through-the-layers direction after the newly laid winding yarns 230 are condensed together, much like in sewing. The sewing-type of layer integration may result in some impalement of the winding yarns. Additionally, the binder yarns can be inserted through the gaps between the newly formed crossover points 232 of the winding yarns 230 to avoid impalement of the winding yarns, as in the case of the illustrative example presented earlier.

There are several options for the mechanisms of binder yarn placement, including a variety of knitting mechanisms, rapier yarn transfer mechanisms, shuttles, sewing stations, among others.

In embodiments shown in FIGS. 2 and 3-6, a plurality of binder yarn insertion needles 240 is utilized to insert the binder yarns through the layers of winding yarns to form open loops by the folded binder yarns. The apparatus 200 may also have a holding yarn feeding needle 272 and a holding yarn insertion needle 274 positioned in relation to the plurality of binder yarn insertion needles 240. When the plurality of binder yarn insertion needles 240 inserts the binder yarns through the plurality of winding yarn layers to form open loops by folding the binder yarns, the holding yarn feeding needle 272 and the holding yarn insertion needle 274 move a holding yarn through the binder yarn open loops to lock the binder yarns in the fabrics.

Preferably, the apparatus 200 is equipped with the same number of needle sets for the binder yarn and the holding yarn as the number of winding yarn packages for fast operating speed. The motion of each needle set follows the command by the control system. As a minimum, only one holding yarn needle pair is needed. In such a case the needle pair completes one turn of movement in the circumferential direction relative to the laid winding yarn layers in each fabrics forming cycle.

As shown in FIG. 2, the apparatus 200 also has one or more beating bars 260 adapted for inserting through openings of the laid winding yarns for a beat-up motion at a predetermined time to push the binder yarns toward the fell 205 of the fabrics.

In operation, the one or more beating bars 260 penetrates through openings of the laid winding yarns 230 for the beat-up motion at appropriate time to push the winding yarns 230 toward the fabrics fell 205 in preparation for binder yarn insertion. The beat-up motion prior to binder yarn insertion allows the binder yarns to be placed as close to the fabrics fell 205 as possible. The beating bar may be fitted with rotating wheels or low friction materials, together with appropriate geometry, to minimize abrasion and damage to the winding yarns. Alternatively or in addition to the pre-insertion beat-up, a post-insertion beat-up motion may follow the binder yarn insertion to push the newly inserted binder yarn to the fabrics fell 205. Similar motion may be accomplished with a single beating bar traveling in the circumferential direction, although multiple bars are preferred for operation effectiveness and efficiency.

The apparatus 200 further comprises a plurality of rings 251, 253 and 255 adapted for condensing the plurality of winding yarn layers and supporting the winding yarn layers while the binder yarns are inserted and during the beat-up motion. The positions of the plurality of rings are changeable during each cycle of fabrics formation.

In addition, the apparatus 200 may further have an auxiliary bar (not shown) accompanying each binder yarn insertion needle 240 for keeping the binder yarn loop open while the holding yarn is inserted, and for tightening the binder yarn after the holding yarn is inserted while limiting the bending curvature in the binder yarn as it is tightened.

The apparatus may include a knitting mechanism having a needle and a yarn feeder to form a loop of the holding yarn that goes through the open loop of the folded binder yarn, wherein the holding yarn is adapted for holding the binder yarn in place, and preventing the binder yarn from being pulled out as the binder yarn insertion needle retreats and the slacks in the binder yarn is removed.

According to the present invention, integrated hollow fabric structures can be produced in connection with the apparatus as disclosed above, according to the following steps: at first, a plurality of crossover points of the winding yarns is formed by moving at least one winding yarn carrier along the second direction. The movements are controlled by a control system according to the integration pattern. Then, the binder yarns are transported or inserted through the plurality of winding yarn layers at predetermined locations along the first direction and are locked in place. The binder yarns are pushed toward the plurality of crossover points of the winding yarns to form multilayer fabrics. A condensing motion, if desired, further compacts the fabric. The formed multilayer fabrics are then taken up. The above steps are repeated until the multilayer fabrics are fabricated to have desired dimensions.

The process can be operated in a continuous or stepwise motion with the synchronization of the motions of the winding yarn carriers, binder yarn insertion, beat-up and take-up of the fabrics.

Figure 3:
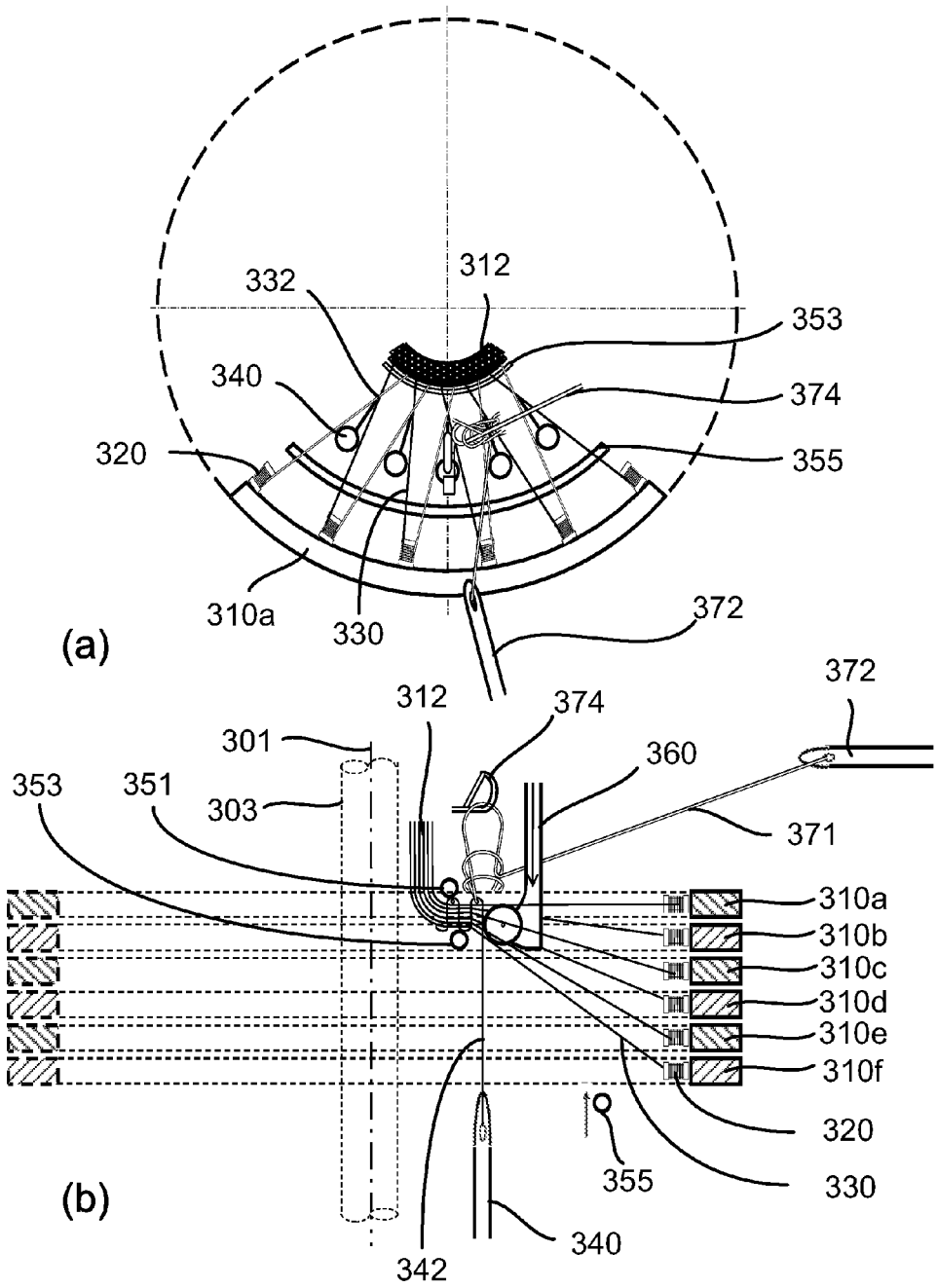
FIGS. 3-6 show schematically a sequential process for fabricating multilayer fabrics in connection with an apparatus according to one embodiment of the present invention, (a) a top view of the apparatus, and (b) a cross-sectional view of the apparatus.

As shown in FIG. 3, six ring-like winding yarn carriers 310*a*-310*f* are employed. Before starting the process, each winding yarn ring carrier 310*a*, 310*b*, 310*c*, 310*d*, 310*e* or 310*f* is furnished with winding yarn packages 320 and the yarn ends are tied to the mandrel 303 placed inside the ring 351 along the mandrel axis 301 whose diameter matched the inner diameter of the tubular fabrics 312 to be produced. After an initial run to reach steady-state, the following steps complete one cycle: at first, winding yarn carriers 310*a*-310*f* are moved, according to the designed/prescribed fabrics pattern, to deposit the winding yarns 330. In this embodiment, winding yarn carriers 310*a* (top) and 310*f* (bottom) move in the positive (counterclockwise) direction for one step, winding yarn carriers 310*b* and 310*e* in the negative (clockwise) direction for one step, winding yarn carrier 310*c* remains stationary, and winding yarn carrier 310*d* completes one revolution. Then, the brakes for the winding yarns 330 are activated for stopping depositing the winding yarns 330. Next, the beating bar 360 moves to the fabrics fell for beat-up and then retreats. The binder yarn 342 is inserted through the openings between the winding yarn crossover points 332. The binder yarn 342 is inserted and locked in place by a holding yarn 371. At this step, any slacks in the binder yarn and holding yarn are removed. The control system (not shown) determines whether the binder yarn insertion is complete. If the binder yarn insertion is not complete, the process will repeat until each binder yarn loop inserted through the winding yarn layers is locked in place by the holding yarn. Otherwise, the fabrics may be optionally condensed and the brakes for the winding yarns 330 are released. Then, the fabricated fabric 312 is taken up by the mandrel 303 in a pre-set distance or rate. The control system determines whether the desired fabrics are done. If the desired fabrics are done, the fabricating process ends. Otherwise, the parameters may be adjusted if needed, then, the process is repeated.

The processing sequence may be adjusted and the motions may be continuous or stepwise. The combination of the speeds of the winding yarn carriers (step size of carrier motion) and the speed of fabrics take-up in the machine direction (step size of mandrel movement) determines the local yarn orientations in the fabrics. By varying the speed of the yarn carriers relative to that of fabrics take-up, the yarn orientations can be altered as required. Therefore it is possible to produce fabrics with varying ply angles along the length by adjusting the relative speeds of winding and take up as the fabrics are formed. To wind the layer at close to 90°, the number of active yarns drawn from packages should be limited or thinner yarns should be used accordingly for desired layer thickness.

FIGS. 3-6 show schematically one example of the binder yarn insertion and the corresponding locking mechanism according to one embodiment of the present invention. Auxiliary parts and some movements of the parts are omitted herewith as they are known to people skilled in the art. A plurality of binder yarn insertion needles 340 insert the binder yarns 342 through the layers of winding yarns 330 to form open loops defined by the folded binder yarns such that a holding yarn 371 may go through the loops to lock the binder yarns 342. An auxiliary bar (not shown) may accompany each binder yarn insertion needle 340 to keep the binder yarn loop open while the holding yarn 371 is inserted, and to help tightening the binder yarn 342 after the holding yarn 371 is inserted while limiting the bending curvature in the binder yarn 342 as it is tightened. A knitting mechanism including a needle and yarn feeder forms a loop of the holding yarn which goes through the open loop of the folded binder yarn. The purpose of the holding yarn 371 is to hold the binder yarn 342 in place in the fabrics 312, and to prevent the binder yarn 342 from being pulled out as the binder yarn insertion needle 340 retreats and the slacks in the binder yarn 342 is removed.

The sequence of forming holding yarn loops to lock the binder yarn is as follows, with steps (a) to (d) illustrated in FIGS. 3-6, respectively:

At step (a), as shown in FIG. 3, the moving ring 355 is lowered to reduce friction among the winding yarns 330 as a given amount of winding yarns 330 are released by the angular motion of the winding yarn carriers 310*a*-310*f*. The beating bar 360 is pushed into the winding yarn layers for beat-up prior to binder yarn insertion, and then the moving ring 355 is raised to condense the winding yarn layers. The beating bar 360 is then retreated.

Figure 4:
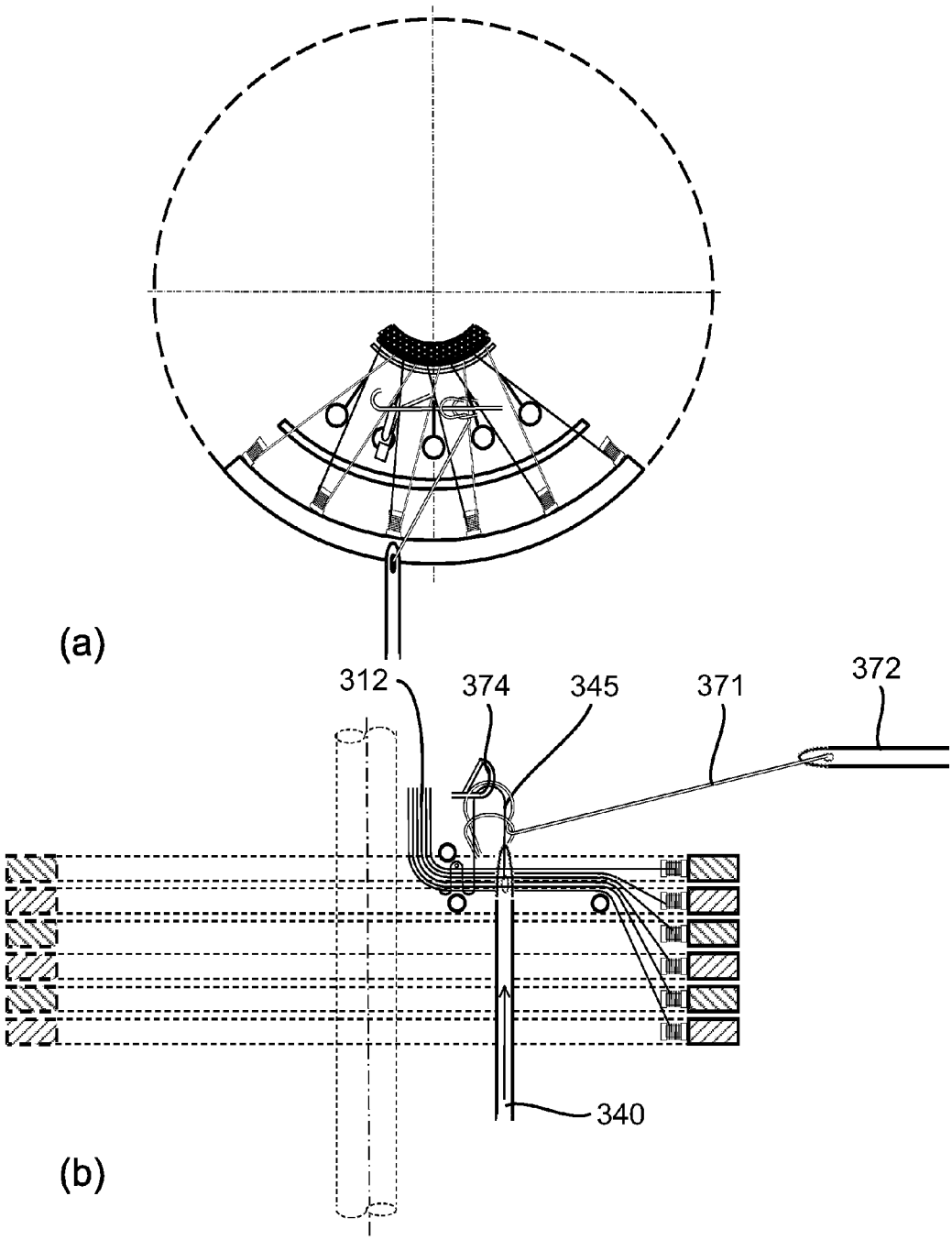

At step (b), as shown in FIG. 4, the binder yarn insertion needles 340 penetrate through the openings in the winding yarn layers to expose holding open loops 345 on the top surface of the fabrics 312. The holding yarn insertion needle 374 penetrates through the binder yarn loop 345.

Figure 5:
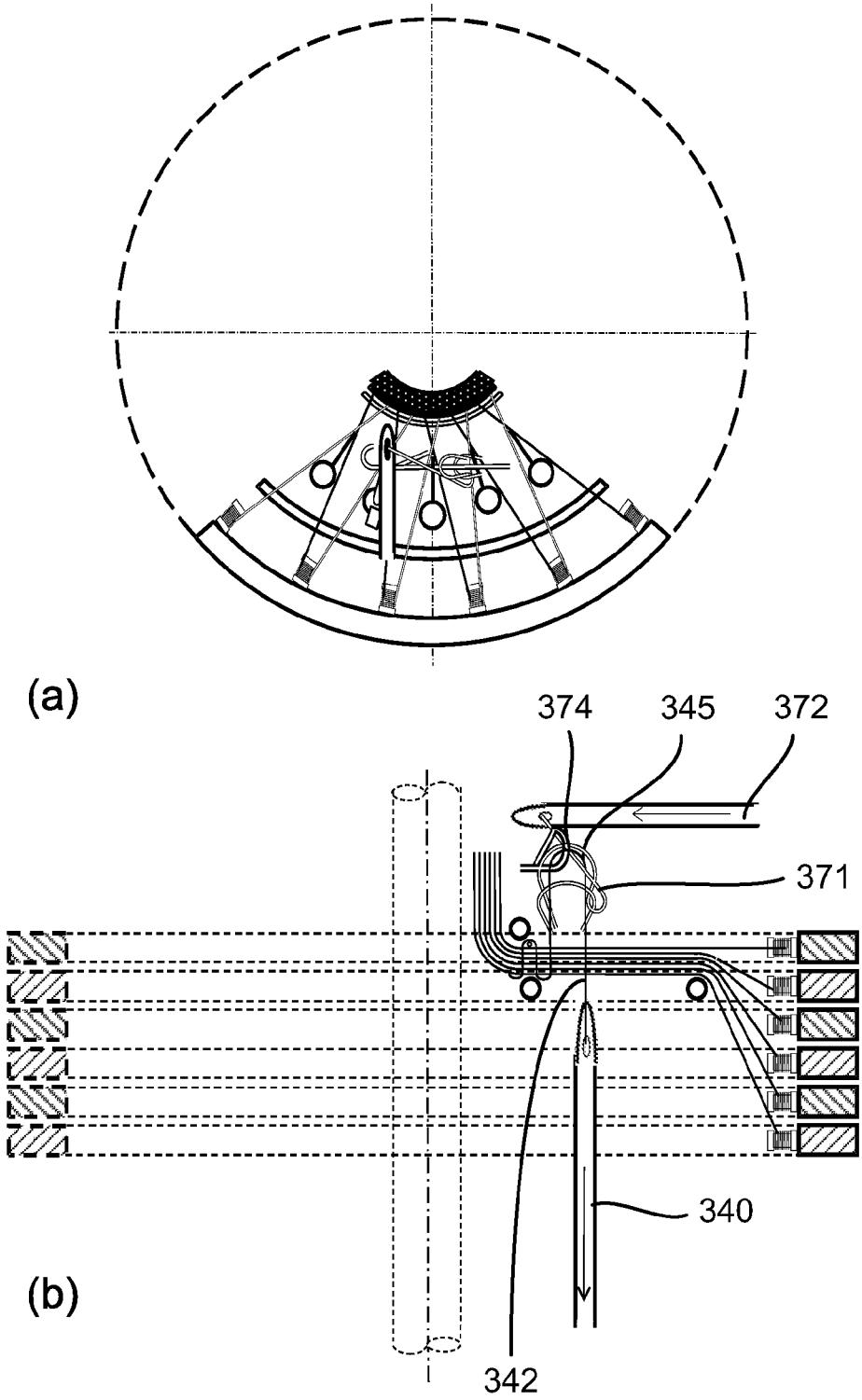

At step (c), as shown in FIG. 5, the binder yarn insertion needles 340 retreat from the top surface of the fabrics 312 without tightening the binder yarn 342. The holding yarn feeding needle 372 moves inward so as to feed the holding yarn 371 to the hook of the holding yarn insertion needle 374.

Figure 6:
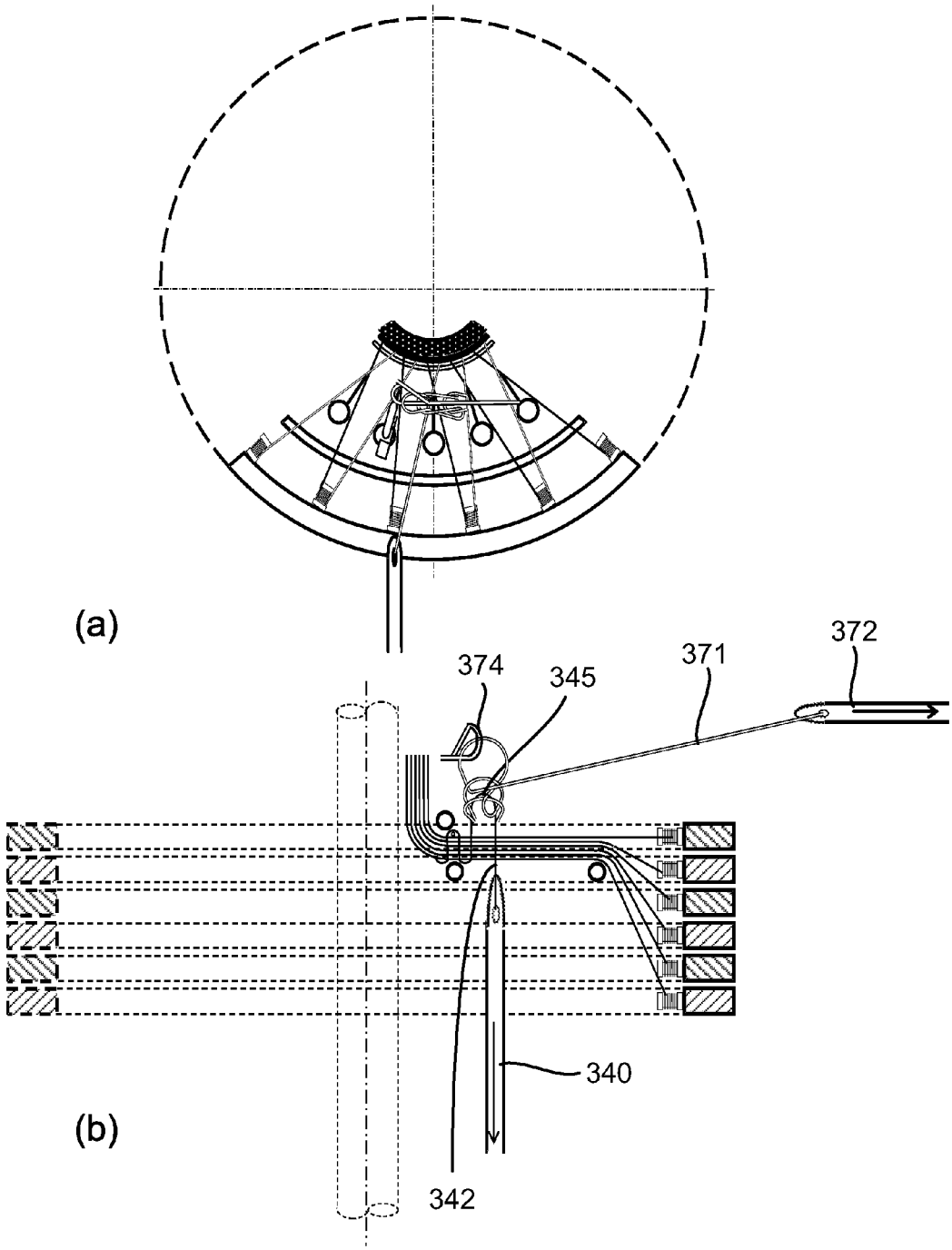

At step (d), as shown in FIG. 6, the holding yarn insertion needle 374 retreats through the binder yarn loop 345 and lock the holding yarn 371 into the previous holding yarn loop. The binder yarn 342 is tightened as the binder yarn insertion needle 340 retreats further.

The holding yarn insertion mechanism moves circumferentially to the next binder yarn location, and steps (c) and (d) are repeated until all the binder yarns 342 are locked and tightened.

There are several other options for the mechanisms of holding yarn placement, including a variety of knitting mechanisms, rapier yarn transfer mechanisms, shuttles, sewing stations, self-locking, among others.

The newly formed fabric may be condensed in any direction or directions relative to the fabric, including circumferential direction, thickness direction or a combination of directions, by motion of condensing element or elements (not shown). The mandrel carrying the fabrics advances upward for fabrics take-up.

The above steps are repeated until the entire piece of fabrics is completed.

In this illustrative example, the mandrel carrying the finished fabrics moves upwards such that the holding yarn (or binder yarn if holding yarn is not used) loops will be on the outer surface of the fabrics. Alternatively, the mandrel and the fabrics can move through the rings downwards such that the loops formed by the holding yarn (or binder yarn if holding yarn is not used) appear on the inner surface of the fabrics.

According to the present invention, the insertion and locking of each binder yarn by the holding yarn at any given point can be executed or omitted via the control system, and therefore the integration pattern can be altered as desired even within the same piece of fabrics.

Figure 7:
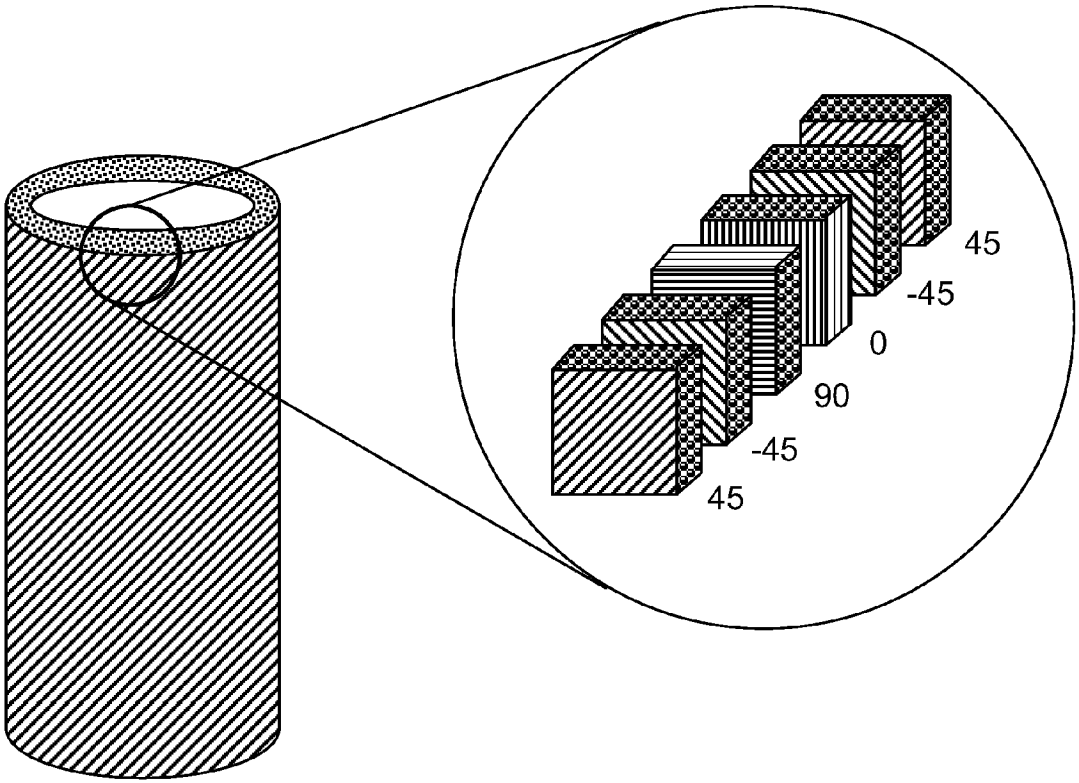
FIG. 7 shows schematically tubular fabrics with a [45/−45/0/90/−45/45] layup according to one embodiment of the present invention, where the ply orientations from inner surface to outer surface are given in degrees.

The movements of one or more winding yarn carriers in opposite directions create a plurality of crossover points by the corresponding winding yarns, which influence the pattern of the fabrics. FIG. 7 shows an example of tubular fabrics with a [45/−45/0/90/−45/45] layup, according to one embodiment of the present invention, where the ply orientations from inner surface to outer surface are given in degrees.

Figure 8:
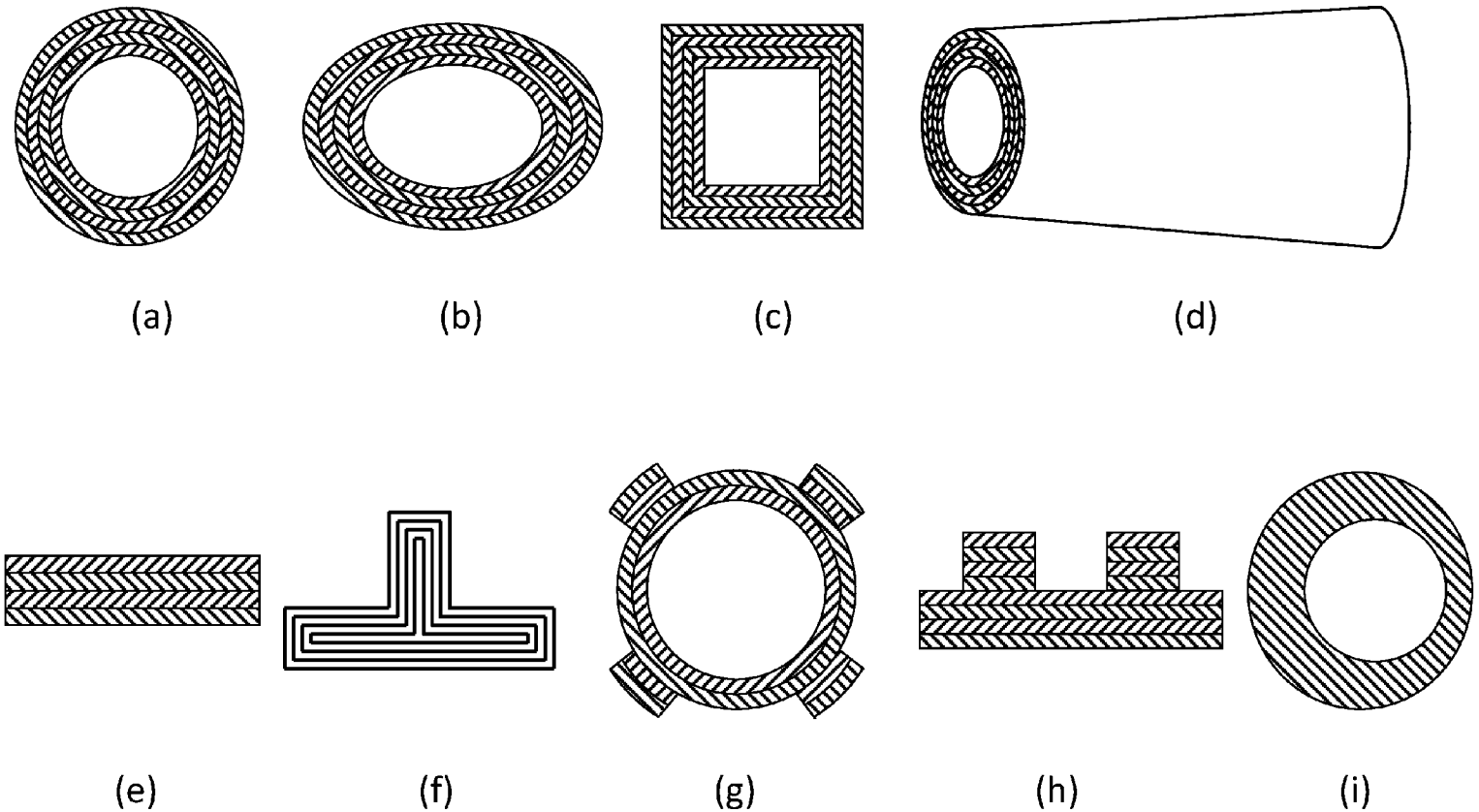
FIG. 8 shows schematically the fabrics of various cross-sectional shapes (a)-(i) fabricated according to embodiments of the present invention.

Fabrics of various cross sectional shapes may be formed according to the above disclosed method. Some of them are illustrated in FIG. 8 as examples. Besides capable of making cylindrical tubular structures (a), many variants are available to produce fabrics with different cross sectional shapes and varying cross sectional shapes along the length. The mandrel can be noncircular in shape to produce fabrics having noncircular cross sections such as those depicted in (b) and (c). The size or shape of the cross-sectional of the fabrics can also vary along the length, such as (d). In another variant, a mandrel is not use but a shaping mechanism is used instead so as flat (e) or other shaped sections (f) can be produced. A flat sectioned panel can also be made by cutting open a tubular fabric (a), and a T-section (f) can be formed by collapsing tubular fabric (a). Normally the winding yarns from each carrier form a continuous layer of yarns in the fabrics when the carrier moves in one generally direction. However, by strategically placing yarn packages at appropriate locations in the carrier and having the carrier move alternatively in a back and forth motion, a discontinuous layer may be laid. A single or a plurality of such discontinuous layers manifests themselves as ribs of the fabrics (g). The width, height, and interval of the ribs may be varied as required. The ribs may be on the outer, inner or both faces of the fabrics. Flat sectioned fabrics with ribs may be obtained by cutting open a tubular ribbed fabric (g). Fabrics with varying wall thickness within a cross-sectional (i) can be made by changing the amount of axial (0 degree) yarns at different cross sectional locations, by placing incomplete layers of winding yarns, or both.

In sum, the present invention, among other things, recites integrated hollow fabric structures and their variants that can be tailored to have a variety of constant or variable cross sectional shapes, constant or variable yarn orientation and integration patterns according to requirements for local yarn architecture and fabrics geometry.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An integrated hollow fabric structure of a generally cylindrical shape having a central axis, comprising:

(a) at least first and second groups of winding yarns, each group having a plurality of winding yarns regularly arranged in one or more layers, wherein the winding yarn layers of the first and second groups are alternately stacked in the radial direction to define an inner surface, an outer surface and a radial thickness therebetween, and wherein the plurality of winding yarns of the first group is helically oriented at a first angle, $\alpha 1$, relative to the central axis, and the plurality of winding yarns of the second group is helically oriented at a second angle, $\alpha 2$, relative to the central axis, thereby defining a plurality of crossovers; and (b) a plurality of binder yarns, each binder yarn defining alternately a plurality of binder loops and a plurality of holding loops interlaced with corresponding crossovers for interlocking the winding yarn layers of the first and second groups, wherein each binder loop receives at least one crossover at one surface and each holding loop is placed between crossovers and exposed to the other surface.

2. The integrated hollow fabric structure of claim 1, wherein the plurality of winding yarns of each group is disposed substantially in parallel respect to one another.

3. The integrated hollow fabric structure of claim 1, wherein $-90° \leqq \alpha 1 \leqq 90°$, and $-90° \leqq \alpha 2 \leqq 90°$.

4. The integrated hollow fabric structure of claim 1, wherein the angle $\alpha 1$ of different winding yarn layers of the first group is the same or substantially different, and wherein the angle $\alpha 2$ of different winding yarn layers of the second group is the same or substantially different.

5. The integrated hollow fabric structure of claim 1, wherein the plurality of binder yarns forms additional loops to lock themselves therein.

6. The integrated hollow fabric structure of claim 1, further comprising at least one holding yarn received in the holding loops of the plurality of binder yarns.

7. The integrated hollow fabric structure of claim 6, wherein the at least one holding yarn is disposed on the outer surface circumferentially, axially, or along another direction.

8. An integrated hollow fabric structure, comprising:

(a) a body having an axis and a thickness along a direction perpendicular to the axis;

(b) at least first and second groups of yarns, the yarns of each of the at least first and second groups space-regularly disposed in layers, wherein the yarn layers of the at least two groups of yarns are alternately stacked and interlocked together, and embedded in the body;

(c) a third group of yarns through the thickness of the body to interlock the layers together, wherein the positions and the pattern of interlock vary according to the need; and (d) at least one holding yarn that is interlocked with the third group of yarns.

9. The integrated hollow fabric structure of claim 8, wherein the yarns of each of the at least first and second groups are disposed substantially in parallel respect to one another and are inclined with respect to the axis of the body.

10. The integrated hollow fabric structure of claim 8, wherein the yarns of the first and second groups define a plurality of crossovers.

11. The integrated hollow fabric structure of claim 8, wherein the winding yarns of the first group are inclined at a first angle, $\alpha 1$, relative to the axis of the body, and the winding yarns of the second group are inclined at a second angle, $\alpha 2$, relative to the axis of the body.

12. The integrated hollow fabric structure of claim 11 wherein $-90° \leqq \alpha 1 \leqq 90°$, and $-90° \leqq \alpha 2 \leqq 90°$.

13. The integrated hollow fabric structure of claim 11, wherein the angle $\alpha 1$ of different winding yarn layers of the first group is the same or substantially different, and wherein the angle $\alpha 2$ of different winding yarn layers of the second group is the same or substantially different.

14. The integrated hollow fabric structure of claim 8, wherein the third group of yarns forms loops to lock themselves therein.

15. The integrated hollow fabric structure of claim 8, wherein the third group of yarns is oriented along the axis direction of the body, the circumferential direction of the body, or any other direction.

16. The integrated hollow fabric structure of claim 8, wherein the body has a cross sectional profile that is in a regular or irregular shape.

17. The integrated hollow fabric structure of claim 16, wherein the cross sectional profile varies along the axis direction.

18. The integrated hollow fabric structure of claim 8, where the body is formed of material, stable or unstable at the elevated temperature.

19. The integrated hollow fabric structure of claim 8, wherein the body is formed of carbonaceous or non carbonaceous.

20. The integrated hollow fabric structure of claim 8, wherein the integrated hollow fabric structure has a cross-sectional geometry of an integrated hollow circular, an integrated hollow oval, an integrated hollow square, or an integrated hollow rectangle, and wherein the integrated hollow fabric structure has a thickness that is uniform or variable.

21. The integrated hollow fabric structure of claim 8, wherein the integrated hollow fabric structure has a flat or a T-like shape with a solid cross section, and wherein the integrated hollow fabric structure has a thickness that is uniform or variable.

22. The integrated hollow fabric structure of claim 8, wherein the integrated hollow fabric structure incorporates a mandrel used to shape the fabric.

* * * * *